United States Patent [19]

Bright et al.

[11] 3,978,010

[45] Aug. 31, 1976

[54] AQUEOUS WINDSHIELD CLEANER FORMULATION COMPRISING AMINE SALTS, METHANOL AND BORIC ACID

[75] Inventors: D. Bruce Bright, Ferguson, Mo.; Paul J. Alderholt, Belleville, Ill.

[73] Assignee: Shell Oil Company, Houston, Tex.

[22] Filed: Dec. 20, 1973

[21] Appl. No.: 426,838

[52] U.S. Cl. ..... 252/525; 252/524; 252/153; 252/539; 252/DIG. 14; 252/546; 252/527; 252/182

[51] Int. Cl.[2] ..... C11D 3/006; C11D 1/18

[58] Field of Search ..... 252/136, 524, DIG. 10, 252/527, 546, 539, 139, 153, 152, DIG. 14

[56] References Cited

UNITED STATES PATENTS

| | | | |
|---|---|---|---|
| 2,271,635 | 2/1942 | Flett | 252/558 |
| 2,313,425 | 3/1943 | Flaxman | 252/139 |
| 2,396,938 | 3/1946 | Bersworth | 252/153 |
| 2,524,380 | 10/1950 | Flaxman | 252/139 |
| 3,696,043 | 10/1972 | Labarge et al. | 252/153 |

FOREIGN PATENTS OR APPLICATIONS

| | | |
|---|---|---|
| 1,068,413 | 11/1959 | Germany |
| 6,403,079 | 9/1965 | Netherlands |

OTHER PUBLICATIONS

Bennett, The Chemical Formulary, vol. IV, pp. 504–507 (1930).

Gergy, "Sesquestrene", p. 3, 1952.

*Primary Examiner*—John D. Welsh

[57] ABSTRACT

Improved glass-cleaning composition particularly adapted for use in cleaning windshields and other glass surfaces exposed to the external environment during operation of motor vehicles. The compositions consist essentially of (a) an amine salt of an aminopolycarboxylic acid chelating agent, (b) an amine salt of a linear alkylated aryl sulfonic acid, (c) an inhibitor of brass corrosion, (d) methanol and/or (e) water, and optionally, (f) boric acid, in certain proportions.

7 Claims, No Drawings

AQUEOUS WINDSHIELD CLEANER FORMULATION COMPRISING AMINE SALTS, METHANOL AND BORIC ACID

BACKGROUND OF THE INVENTION

It is well known that the external surfaces of glass used in automobiles and other motor vehicles accumulate two general forms of foreign matter during operation of the vehicle. One form, generally termed "visible dirt", consists of dust, mud, residues from insects, and the like. The other form consists of a hydrophobic film (often called road film) composed primarily of organic material such as unburned fuel, lubricating oil, products of fuel combustion, the the like, emitted from other vehicles, and/or thrown up from the road surfaces by passage of other vehicles. This form also is often termed "invisible dirt" because it is not readily noticeable under many lighting conditions where the intensity of the light from the surroundings does not differ greatly from that of the interior of the vehicle. The dirt becomes highly visible, however, when the light intensity on the two sides of the glass differs greatly — from a darkened vehicle, the film causes the glass to tend to act as a mirror; approaching a brilliant light source, such as the sun near the horizon, or the lights of an oncoming vehicle the film increases "glare" and also may cause the glass to tend to act as a mirror. In both situations, visibility through the glass is markedly reduced, increasing the danger of operating the vehicle. Another situation when the invisible dirt becomes highly visible — to the detriment of vision through the glass — is when condensed moisture appears on the outer surface of the glass, the wiping action of the windshield wiper, or a cloth, used to remove the moisture, causes a smearing action resulting in streaking or "fogging" of the glass.

It is relatively easy to remove the visible dirt, but very difficult to remove the invisible dirt.

These glass contamination problems are discussed in some detail in such patents as U.S. Pat. Nos. 2,313,425, 3,304,264 and 3,309,321.

To be useful for cleaning such glass surfaces, a cleaning composition thus must be able to remove the invisible dirt as well as the visible dirt. Moreover, the cleaner must be capable of use on the vehicle under the expected range of climatic conditions — it must not freeze at the low temperatures, nor evaporate at unduly high rates at the high temperatures that may be encountered in use of the vehicle — and it must be compatible — that is, it must not corrode metals it contacts such as the parts of the washing equipment and metal trim around the glass or adversely affect the body finish of the vehicle. Furthermore, from the marketing standpoint, it is very desirable that these characteristics appear in a single composition rather than requiring a series of compositions each of which is adopted only for a use under particular climatic conditions. Thus, it is common practice to market an "all-weather" composition for use in both summer and winter. Such a composition ordinarily is sold as a concentrate which is suitable for use in winter — i.e., it has a low freezing point. The concentrate then is diluted with water to prepare a composition suitable for summer use — i.e., it has a relatively high freezing point but relatively low volatility, since if the composition dries too quickly, it may dry before cleaning of the glass has been effected or may interfere with the cleaning. Also, of course, it is always desirable to use as dilute a composition as possible employing minimum amounts of chemicals to reduce contamination of the environment and to reduce the cost of using the composition.

Further, for convenience, ordinary tap water is usually employed as the diluent. Since this may be "hard" water containing dissolved calcium salts, it is desirable that the cleaning composition not be affected by such salts — i.e., that no precipitated material form and no change in the cleaning properties result from addition of such hard water to the cleaning composition.

SUMMARY OF THE INVENTION

Compositions which have superior properties for removing the invisible dirt and which meet all of the other criteria for an effective vehicle glass cleaner have been found. They consist essentially of the following components, in certain proportions:

1. an amine salt of an aminopolycarboxylic acid chelating agent;
2. an amine salt of a linear alkylated aryl sulfonic acid;
3. an inhibitor of copper and brass corrosion;
4. methanol and/or
5. water Optionally, and preferably, certain amounts of boric acid are included.

PREFERRED EMBODIMENTS OF THE INVENTION

The first essential component of these new cleaner formulations is an aminopolycarboxylic acid chelating agent, typical species of this class of acids being ethylenediaminetetraacetic acid (edetic acid; EDTA), nitrolotriacetic acid (NTA), diethylenetriaminepentaacetic acid (Penthanil; DTPA), hydroxyethylethylenediaminetriacetic acid (HEDTA) and N-hydroxyethylaminodiacetic acid. Preferred is EDTA. Where an aminopolycarboxylic acid other than EDTA is used, the amount is determined by the requirement that it provide chelating activity that would be equivalent to EDTA in that composition. These acids have three to five acidic hydrogen atoms; the partial salts or the full salts of these acids can be used. If a partial salt is used, preferably at least about 75 percent of the acidic hydrogens have been neutralized; preferably the full salt is used. These salts are readily prepared by adding the acid to a thoroughly stirred solution of the amine in water, then recovering the salt, or it may be convenient to employ the resulting solution directly in the preparation of a cleaner composition of this invention.

The second essential component is an amine salt of an anionic linear alkylated aryl sulfonic acid. The suitable acid can be defined by the formula: R—Ar—$SO_3H$, wherein R is straight-chain alkyl of from 5 to 20 carbon atoms and Ar is the benzene or naphthalene ring. Preferred are the ($C_{12}$- and $C_{13}$- alkyl) benzenesulfonic acids, such as dodecylbenzenesulfonic acid and tridecylbenzenesulfonic acid. Typical materials of this kind include Conco AAS-98S and Conco ATR-98S (Continental Chemical Co.), Conoco SA 597 and SA 697 (Continental Oil Co.), Sulframin-1288, 1298, and OBS (Witco Chemical Corp.), Ultrawet 99 LS acid (Arco Chemical Co.), Ardet sulfonic acid (Ardmore Chemical Co.), Sulfotex DBL-88 and -100, UBL-88 and -100 (Textilana Corp.), BIOSOFT S-100 (Stephan Chemical Co.), Nansa SSA-055 (Albright and Wilson), Calsoft LAS-99 (Pilot Chemical Co.), Marlon $AS_3$- säure (Malmstrom Chemical Co.), Cedepon Acid 100 (Chemical Developments of Canada) and Crestonol Bio-acids (Crest Chemical Co.). In addition to providing the necessary cleaning power, these acids and the amine salts of thereof are bio-degradable to form innocuous products, thus minimizing any adverse effect upon the ecology of the environment in which they are used.

The amine salts of the chelating agent and of the sulfonic acid must be soluble in water in the proportions used in the compositions of this invention. Thus, any amine(s) that provide(s) the water-soluble salts is contemplated in this invention. As used herein, the term "amine" thus includes ammonia, as well as aliphatic primary, secondary and tertiary amines, including heterocyclic amines having a saturated ring. Suitable amines thus include ammonia, aliphatic amines such as mono-, di- and tri-methylamines, mono-, di- and tri-methanolamines, the corresponding ethyl, propyl and butylamines, iso-octyl amine, stearylamine, dodecylamine. A list of commercially available suitable amines is given on pages 118–119, volume 2, of Kirk-Othmer, "Encyclopedia of Chemical Technology", 2nd Edition, Interscience (1963). Heterocyclic amines, such as morpholene, piperidine, pyrrolidine and the like also are suitable.

The amine salts of these acids can be prepared in the same amnner as described herein for the preparation of the amine salts of the aminopolycarboxylic acids. In fact, it may be convenient to prepare both salts by adding both acids to an aqueous solution containing the necessary amount of the amine, then adding the other ingredients to make the desired composition.

While the salt of the aminopolycarboxylic acid can be that of a different amine than the salt of the sulfonic acid, it may be found to be desirable that both of the salts be those of the same amine, thus reducing the number of different ions in the final product.

The remainder of the new compositions consists essentially of methanol and/or water, preferably both. Technical or commercial methanol is suitable, provided any water content is taken into account when preparing a given composition. Preferably, the water used is soft, and still more preferably, is distilled or demineralized. A significant factor which must be taken into account in preparing a given composition is the temperature range within which that composition is to be used. In general, the lower the expected use temperatures, the higher the methanol concentration required — to depress the freezing point of the composition to below the expected use temperature. On the other hand, for use at higher temperatures, it may be undesirable to have a high proportion of methanol because the composition may be too volatile and dry on the glass before cleaning has been effected. Selection of the amounts of methanol and water to be used in any given case is easily determined from the known properties of methanol/water systems and employing the criteria set out herein.

It is to be appreciated that while this invention provides "all-weather" compositions — i.e., concentrates which may be used neat or slightly diluted for use in cold weather — the invention is not limited thereto. Thus the invention also provides compositions that have the same cleaning and compatibility characteristics as the all-weather compositions, but which are suitable only for use under milder temperature conditions.

While its presence may not be of advantage in some cases, it is of definite advantage in others, particularly where the cleaning composition is to be used at low temperatures so it is preferred that boric acid be included in the compositions.

The final cleaning composition is basic. It is to be appreciated that final composition is in equilibrium so that it may not have precisely the composition which is the sum of the components which are mixed. In particular, where boric acid is added, the final mixture undoubtedly will contain some salt formed by boric acid and the amine base.

The relative proportions of the components of these compositions will depend upon several factors, such as the particular amine(s) in the salts and the particular sulfonic acid employed. In general, however, the superior properties of the cleaning compositions provided by this invention are attained when the ingredients are present in about the following weight proportions, based on 100 parts by weight:

| | Weight Proportion |
|---|---|
| Amine salt of edetic acid | 0.001 – 5 |
| Amine sulfonate | 0.01 – 10 |
| Boric acid | 0.02 – 3 |
| Corrosion inhibitor | 0.0005 – 0.5 |
| Methanol | 5 – 60[1] |
| Water | remainder[2] |

[1]taking into account any water added and the expected use temperature;
[2]taking into account any methanol added and the expected use temperature.

Preferably the proportions are:

| | Parts by Weight |
|---|---|
| Amine salt of edetic acid | 0.01 – 3.0 |
| Amine sulfonate | 0.1 – 3.0 |
| Boric acid | 0.02 – 1.0 |
| Corrosion inhibitor | 0.001 – 0.05 |
| Methanol | 5 – 60 |
| Water | remainder |

Optimum results appear to be obtained when the proportions are about:

| | Parts by Weight |
|---|---|
| Amine salt of edetic acid | 0.15 – 1.5 |
| Amine sulfonate | 0.09 – 1.6 |
| Boric acid | 0.08 – 0.5 |
| Corrosion inhibitor | 0.0015 – 0.01 |
| Methanol | 6.5 – 39 |
| Water | remainder |

The compositions containing the first four ingredients in the higher amounts represent "concentrates", which may be used as such, or which may be diluted for use, the final product lying within the lower limits indicated.

In the cases of particular amine salts, both salts of the same amine in each case, the preferred ranges are as follows:

| | Parts by Weight |
|---|---|
| Ammonium salt of edetic acid | 0.09 – 0.63 |
| Ammonium sulfonate | 0.15 – 1.0 |
| Boric acid | 0.08 – 0.50 |
| Methanol | 6.50 – 39 |
| Water | remainder |

| | Parts by Weight |
|---|---|
| Triethanolamine salt of edetic acid | 0.25 – 1.56 |

-continued

| | |
|---|---|
| Triethanolamine sulfonate | 0.30 - 1.46 |
| Boric acid | 0.08 - 0.50 |
| Corrosion inhibitor | 0.0015 - 0.01 |
| Methanol | 6.50 - 39 |
| Water | remainder |

| | Parts by Weight |
|---|---|
| Morpholinium salt of edetic acid | 0.1 - 1.13 |
| Morpholinium sulfonate | 0.20 - 1.26 |
| Boric acid | 0.08 - 0.50 |
| Corrosion inhibitor | 0.0015 - 0.01 |
| Methanol | 6.50 - 39 |
| Water | remainder |

These new formulations have been found (a) superior to commercial cleaners in ability to remove invisible dirt (road film); (b) equal to or better than such commercial cleaners with respect to removal of visible soil, noncorrosivity and tolerance to hard water. They are "flexible" in that they can be made-up with low-freezing point concentrates which can be diluted with up to five parts water per part of concentrate without loss of cleaning power.

The properties of these new compositions are demonstrated in the following examples which illustrate preparation and testing of particular compositions. In all cases, "parts" means parts by weight.

EXAMPLE I — COMPOSITION I 39.218 parts of methanol, 0.496 parts of boric acid, 0.511 parts of edetic acid, 0.01 parts of Reomet SBT, 0.974 part of BIOSOFT S-100 and 2.132 parts of triethanolamine were mixed with sufficient water to form 100 parts of solution.

EXAMPLE II — COMPOSITION II 39.218 parts of methanol, 0.500 parts of boric acid, 0.515 parts of edetic acid, 0.010 parts of Reomet SBT, 0.982 parts of BIOSOFT S-100 and 0.798 parts of morpholine were mixed with sufficient water to form 100 parts of solution.

EXAMPLE III — COMPOSITION III 39.22 parts of methanol, 0.500 parts of boric acid, 0.515 parts of edetic acid, 0.010 parts of Reomet SBT, 0.980 parts of BIOSOFT S-102 and 0.550 parts of $NH_4OH$ (as a solution containing 29% $NH_3$) were mixed with sufficient water to form 100 parts of solution.

EXAMPLE IV — CORROSION TESTS

In this test, a piece of brass shim stock was immersed in the test composition and the results were evaluated visually after 48 hours.

| Composition | Dilution[1] | Results |
|---|---|---|
| I | None | Moderate corrosion above liquid level. Solution clear and uncolored. |
| I | 1:1 | Same |
| II | None | Solution clear. No corrosion |
| II | 1:1 | " |
| III | None | Light corrosion above liquid level. Solution clear. |
| IV | 1:1 | " |

[1]Volume composition: volume tap water

EXAMPLE V — LOW-TEMPERATURE TESTS

Compositions of the invention were held at −26°F for 2 weeks with the following results:

| Composition | Result |
|---|---|
| I | Clear liquid |
| II | Same |
| III | Same |

EXAMPLE VI — WINDSHIELD WASHER TESTS

Road tests were attempted. In these a test automobile followed others on a wet road to obtain road soil on the windshield. When an even coating was deposited, the wet windshield was dried with the defrosters and at speeds of 40 mph and 60 mph, the washer of the car containing the test composition was used and the results noted. These tests were terminated inconclusively because of variations in road film and the difficulty in obtaining uniform test conditions.

The following tests then were performed:

Road soil from the surface and edge of a road was obtained and diluted with water to be used as a standard dirt suspension. A test car was equipped with new wiper blades, and the testing was done in a dynamometer stall as follows: the dirt suspension (about 50 milliliters) was sprayed on the windshield with the wipers on low speed. The wipers were turned off and more dirt suspension was applied evenly over the entire windshield. After thorough drying, the cleaner was applied in washing cycles (each cycle is about ten sprays) through the washer unit. After each cycle the windshield was rated for visible soil removed. Under the glare of a photo light the invisible soil or road film was estimated by the percent of trailing behind the wiper blade while the windshield is being sprayed lightly with water. The windshield and wipers were cleaned thoroughly between tests with a one-eighth methanol/water solution.

The first cleaner tested was water. It was found to remove both the visible dirt and invisible dirt easily. The dirt suspension then was further contaminated by adding 4 drops of used crankcase oil to each 100 milliliters of dirt suspension. When the above test was repeated with water, most of the visible dirt was removed but none of the invisible dirt. The tests then were continued employing the compositions described herein. The results of these tests are given in the following table. The temperature given is the ambient temperature. The high temperature tests were made by closing the doors and using the space heaters.

TABLE I

| Test Number | Composition | Dilution[1] | Temp. °F | Number Wash Cycles | % Dirt Removed Visible | % Dirt Removed Invisible |
|---|---|---|---|---|---|---|
| 1 | I | None | 9 | 1 | 100 | 100 |
| 2 | I | 1:1 | 80 | 1 | 100 | 75 |

TABLE I-continued

| Test Number | Composition | Dilution[1] | Temp. °F | Number Wash Cycles | % Dirt Removed Visible | % Dirt Removed Invisible |
|---|---|---|---|---|---|---|
| | | | | 2 | | 100 |
| 3 | II | None | 16 | 1 | 100 | 100 |
| 4 | II | 1:1 | 82 | 1 | 100 | 80 |
| | | | | 2 | | 100 |
| 5 | III | 1:1 | 80 | 1 | 100 | 75 |
| | | | | 2 | | 100 |
| 6 | A[2] | None | 6 | 1 | 80 | 10 |
| | | | | 2 | 100 | 10 |
| | | | | 3 | | 10 |
| 7 | A[2] | None | 15 | 1 | 90 | 0 |
| | | | | 2 | 90 | 0 |
| 8 | 20/30[3] | 2:3 | 46 | 1 | 100 | 25 |
| | | | | 2 | | 75 |
| | | | | 3 | | 100 |
| 9 | 20/10[3] [4] | 2:3 | 46 | 1 | 100 | 50 |
| | | | | 2 | | 90 |
| | | | | 3 | | 100 |
| 10 | 20/10[3] | None | 20 | 1 | 100 | 40 |
| | | | | 2 | | 90 |
| | | | | 3 | | 100 |
| 11 | 20/10[3] | 1:8 | 85 | 1 | 60 | 40 |
| | | | | 2 | 80 | 50 |
| | | | | 3 | 100 | 60 |
| | | | | 4 | | 60 |
| 12 | 20/10[3] | 1:1 | 88 | 1 | 100 | 75 |
| | | | | 2 | | 100 |
| 13 | Prestone[5] | None | 19 | 1 | 90 | 10 |
| | | | | 2 | 100 | 40 |
| | | | | 3 | | 60 |
| | | | | 4 | | 70 |
| 14 | Shell[6] | 1:1 | 8 | 1 | 90 | 10 |
| | | | | 2 | 100 | 20 |
| | | | | 3 | | 75 |
| 15 | Shell[6] | 1:2 | 48 | 1 | 90 | 25 |
| | | | | 2 | 100 | 50 |
| | | | | 3 | | 75 |
| | | | | 4 | | 75 |
| 16 | Shell[4][6] | 1:2 | 48 | 1 | 80 | 40 |
| | | | | 2 | 100 | 60 |
| | | | | 3 | | 75 |
| | | | | 4 | | 75 |
| 17 | Shell[6] | 1:15 | 89 | 1 | 50 | 50 |
| | | | | 2 | 75 | 75 |
| | | | | 3 | 100 | 75 |
| | | | | 4 | | 75 |
| 18 | Atlas[7] | 1:2 | 19 | 1 | 100 | 60 |
| | | | | 2 | | 90 |
| | | | | 3 | | 100 |
| 19 | Anco[8] | 1:5 | 52 | 1 | 90 | 10 |
| | | | | 2 | 100 | 25 |
| | | | | 3 | | 50 |
| | | | | 4 | | 75 |
| 20 | Anco[8] | 1:5 | 50 | 1 | 100 | 25 |
| | | | | 2 | | 50 |
| | | | | 3 | | 75 |
| | | | | 4 | | 75 |
| 21 | Anco[8] | 1:2 | 18 | 1 | 50 | 40 |
| | | | | 2 | 100 | 50 |
| | | | | 3 | | 90 |
| | | | | 4 | | 100 |

[1]Volume composition: volume tap water.
[2]40% methanol, 60% water, for comparison.
[3]20/10 Winter/Summer Instant Windshield Cleaner, a commercial windshield cleaner, sold by Johnhop, Inc., Beaverton, Oregon.
[4]Repeat.
[5]Prestone Brand Pre-mixed Windshield Washer Antifreeze and cleaner, a commercial windshield cleaner marketed by Union Carbide Corp.
[6]Shell Windshield Washer Solvent and Antifreeze, a commercial windshield cleaner marketed by Shell Oil Co.
[7]Atlas Windshield Washer Solvent and Antifreeze Concentrate, a commercial windshield cleaner marketed by Atlas Supply Co., Springfield, New Jersey.
[8]Anco Windshield Washer Antifreeze Concentrate, a commercial windshield cleaner marketed by The Anderson Co., Gary, Indiana.
[9]Same test except Composition IX substituted for the original test composition.

EXAMPLE VII — COMPATIBILITY WITH HARD WATER

Formula II, a typical composition of this invention, was tested for compatibility with hard water as follows: The composition was diluted with different amounts of hard water, the hardness being expressed as parts per million of calcium carbonate. The mixture then was allowed to stand at room temperature and visually examined after standing at room temperature for 1 day, 4 days and 10 days.

At 1:1 (concentrate/water) volume ratio, the mixture remained clear and showed no visible change for the entire 10 day period at water hardness up to 1100 ppm. At a dilution of 1:4, the mixture remained clear and showed no visible change up to 300 ppm hardness for up to 10 days; at 500 ppm hardness, the mixture was hazy at 1, 4 and 10 days.

What is claimed is:

1. A glass-cleaning composition consisting essentially of the following ingredients in the indicated weight proportions, based on 100 parts by weight:

| | | |
|---|---|---|
| a. | amine salt of an aminopolycarboxylic acid chelating agent | 0.001 to 5.0 |
| b. | amine salt of an anionic linear alkylated aryl sulfonic acid | 0.01 to 10.0 |
| c. | boric acid | 0.02 to 3 |
| d. | inhibitor of copper/brass corrosion | 0.0005 to 0.5 |
| e. | methanol | 5 to 60 |
| f. | water | remainder |

2. A composition according to claim 1 wherein the aminopolycarboxylic acid is edetic acid.

3. A composition according to claim 2 wherein the ingredients have the indicated weight proportions:
a. 0.01 to 3.0
b. 0.10 to 3.0
c. 0.02 to 1.0
d. 0.001 to 0.05, and is benzotriazole or a partially hydrogenated benzotriazole
e. 5 – 60
f. remainder 4. A composition according to claim 3 wherein the ingredients have the indicated weight proportions:
a. 0.15 to 1.5
b. 0.09 to 1.60
c. 0.08 to 0.5
d. 0.0015 to 0.01
e. 6.5 to 39
f. remainder 5. A composition according to claim 2 wherein the salts (a) and (b) are each salts of triethanolamine and the ingredients have the indicated weight proportions:
a. 0.25 – 1.56
b. 0.30 – 1.46
c. 0.08 – 0.5
d. 0.0015 – 0.01
e. 6.5 – 39
f. remainder 6. A composition according to claim 2 wherein the salts (a) and (b) are each salts of morpholine and the ingredients have the indicated weight proportions:
a. 0.1 – 1.13
b. 0.20 – 1.26
c. 0.08 – 0.50
d. 0.0015 – 0.01
e. 6.5 – 39
f. remainder 7. A composition according to claim 2 wherein the salts (a) and (b) are each salts of ammonia and the ingredients have the indicated weight proportions:
a. 0.09 – 0.63
b. 0.15 – 1.0
c. 0.08 – 0.50
d. 0.0015 – 0.01
e. 6.50 – 39
f. remainder

* * * * *